US006250498B1

(12) United States Patent
Lovejoy

(10) Patent No.: US 6,250,498 B1
(45) Date of Patent: Jun. 26, 2001

(54) SPOON DISPENSER

(76) Inventor: Scott Lovejoy, 5108 Hekili Rd., Kapaa, Kauai, HI (US) 96746

( * ) Notice: Subject to any disclaimer, the term of this patent is extended or adjusted under 35 U.S.C. 154(b) by 0 days.

(21) Appl. No.: 09/426,602

(22) Filed: Oct. 26, 1999

(51) Int. Cl.[7] ..... A01C 1/00
(52) U.S. Cl. ..... 221/185; 221/232
(58) Field of Search ..... 221/185, 226, 221/232, 231, 268, 279, 270; 206/216, 223, 553, 527; 224/191, 196

(56) References Cited

U.S. PATENT DOCUMENTS

| | | | | |
|---|---|---|---|---|
| 2,704,627 | * | 3/1955 | Brulin et al. | 221/185 |
| 3,164,295 | | 1/1965 | Shwarz . | |
| 3,471,056 | | 10/1969 | Kovac . | |
| 4,101,053 | | 7/1978 | Mast, Jr. . | |
| 4,239,125 | | 12/1980 | Pawlowski . | |
| 4,275,819 | | 6/1981 | Perez . | |
| 5,285,925 | | 2/1994 | Leight . | |
| 5,706,949 | | 1/1998 | Amato . | |

* cited by examiner

*Primary Examiner*—Kenneth W. Noland
(74) *Attorney, Agent, or Firm*—Michael I. Kroll

(57) ABSTRACT

The present invention 10 discloses a device for holding and dispensing a plurality of spoons 16 in a rapid and easy manner. Disclosed is an enclosure 30 holding a plurality of spoons 16 in a side by side relation whereby the spoons are withdrawn by their handle 42 through an aperture 20 in the top 22 of the enclosure 30. A rotatable belt means 38 is disclosed having hook-like members 46 thereon which contact the spoon tips 44 and thereby eject the spoons 16 from the enclosure. The spoons are held in proper position by a slidably mounted partition 34 having spring means 36 for being biased against the spoons 16. An access door 32 is provided in the enclosure in order to replace spoons 16 when necessary.

17 Claims, 8 Drawing Sheets

SPOON DISPENSER

BACKGROUND OF THE INVENTION

1. Field of the Invention

The present invention relates generally to dispensers and, more specifically, to a device having a holding member having mounting means for selectively positioning said device. Said device having a plurality of open topped container members attached to said holding member providing means for storing disposable spoons therein and retrieving said spoons therefrom for inserting into a portable dispenser which is selectively removed from the holding member and having clip means for attaching said portable dispenser to an apron, pocket or belt. The portable spoon dispenser further having means for selectively dispensing one spoon at a time.

2. Description of the Prior Art

There are other dispensing devices designed for dispensing various articles. Typical of these is U.S. Pat. No. 4,275,819 issued to Perez on Jan. 30, 1981.

Another patent was issued to Amato on Jan. 13, 1998 as U.S. Pat. No. 5,706,949. Yet another U.S. Pat. No. 4,101,053 was issued to Mast, Jr. on Jul. 18, 1978 and still yet another was issued on Dec. 16, 1980 to Pawlowski as U.S. Pat. No. 4,239,125.

Another patent was issued to Leight on Feb. 15, 1994 as U.S. Pat. No. 5,285,925. Yet another U.S. Pat. No. 3,164,295 was issued to Shwarz on Jan. 5, 1965. Another was issued to Kovac on Oct. 7, 1969 as U.S. Pat. No. 3,471,056.

U.S. Pat. No. 4,275,819

Inventor: Sergio J. Perez

Issued: Jan. 30, 1981

A cigarette dispenser for placement upon a dashboard of an automotive vehicle; the dispenser includes a frame for resting on the dashboard top, and a cigarette case containing a row of 20 cigarettes that are pushed by a spring for each cigarette to successively align with a dispensing hole in the case; and a pushrod on the frame in order that when the case is pressed into the frame, the push rod pushes a cigarette out of the dispensing hole.

U.S. Pat. No. 5,706,949

Inventor: Christine Amato

Issued: Jan. 13, 1998

A serving platform for holding and dispensing tableware and utensils at a party or other such function. A covering made from cloth or other suitable material is disposed over a container. The container is preferably a knock-down box. The covering has a plurality of pockets attached thereto for dispensing utensils such as knives, forks or spoons or for dispensing napkins or other tableware. The pockets are disposed along the sides of the container and may be divided into subpockets. The covering may be fitted around the bottom surface of the container.

U.S. Pat. No. 4,101,053

Inventor: John George Mast Jr.

Issued: Jul. 18, 1978

A hand-held, generally T-shaped disposable product applicator and a dispensing package therefor. The applicator comprises a resilient applicator pad portion and an upstanding finger grip portion. The applicator pad portion is normally substantially planar with a top surface and a bottom product applying surface coated or impregnated with the product to be dispensed. The upstanding finger grip portion is normally substantially planar with its sides providing finger grip surfaces. The finger grip portion is substantially normal to and extends transversely across the top surface of the applicator pad portion, bisecting the applicator pad portion into two substantially equal flaps. The applicator pad portion with its bottom product applying surface folded upon itself. The finger grip portion is of such thickness that when the applicator pad portion is in its folded condition each half of the applicator pad portion top surface is substantially coplanar with the adjacent finger grip portion side. The dispensing package is adapted to receive a stack of applicators each with its applicator pad portion in folded condition. The package has a dispensing opening through which the handle portion of the end-most applicator of the stack is exposed for removal. Structure is provided within the package to advance the stack of applicators as each applicator is removed therefrom. Upon removal from the package, the resilient applicator pad portion of each applicator will spring to its normal substantially planar product applying condition.

U.S. Pat. No. 4,239,125

Inventor: Thomas D. Pawlowski

Issued: Dec. 16, 1980

A cup dispensing package comprises an axially collapsible cylindrical sleeve for storing a stack of nested, disposable cups. The sleeve comprises at least a pair of bands at its opposite end portions, axially extending, uniformly circumferentially spaced slits between the bands that define axially extending strips provided with circumferential cut scores, and a detent on one of the bands frictionally engaging the rim of a partially extending cup to retain the latter prior to its forcible removal. The strips fold radially outwardly then downwardly about their cut scores and transverse sections thereof in response to axially applied compressive force on the sleeve, by the user, as the cups are removed, thereby presenting a fully extended frictionally retained cup for dispensing until such time the cup supply is exhausted.

U.S. Pat. No. 5,285,925

Inventor: Howard S. Leight

Issued: Feb. 15, 1994

A container is described which can hold multiple small articles such as earplugs, and which can be inserted into a dispenser where the contents can be readily released. The container includes a box(30, FIG. 3.) Whose bottom wall includes a pair of flaps (50, 52) having inner ends (54, 56) pivotally connected to the bottoms of opposite side walls, and having outer portions (64,66) that lie adjacent to each other. A release device (34) holds the outer portions of the flaps together to prevent them from pivoting down until the release device is pulled out. The outer portion of each flap includes an upstanding tab (76, 78, FIG. 5) with a horizontal slot (82), and the release device includes a cardboard plate which is received in the slot. While the upper walls (84) of the slots press down against the release plate, the widely spaced opposite sides (90,92) of the release plate bear against the upper surfaces (94,96) of the flaps to prevent the tabs (76,78) and therefore the flaps (50,52) from moving down.

U.S. Pat. No. 3,164,295

Inventor: S. W. Shwarz

Issued: Oct. 22, 1962

This United States Patent discloses a cigarette case comprising the combination of a generally rectangular enclosure sufficiently large to accommodate a plurality of cigarettes in side-by-side relation to one another and including a pair of opposite end walls adapted to lie at either end of the cigarettes, a pair of opposed relatively wide side walls extending between said end walls, and a pair of opposed relatively narrow side walls, one of said end walls including exit means to permit end-wise removal of an individual cigarette from said enclosure, said exit means being disposed adjacent to a first of said narrow side walls, manually operable ejector means on said first narrow side wall for at least partially ejecting an individual cigarette through said exit means, and collapsible spring biasing means in said enclosure and secured to the inside of the narrow side wall opposite said first narrow side wall and adapted to urge the cigarettes in the case into position to be ejected from the enclosure by the operation of said ejector means, said narrow side walls having an integral transverse diameter of two cigarettes but which is smaller than the combined diameter of three cigarettes, said biasing means including a collapsible spring section extending from the narrow side wall opposite said first side wall and at least two spaced individually acting resilient spring sections on the free end of said main spring section, said individually acting spring sections being disposed transversely on one narrow side wall and positioned to act individually against a cigarette so that cigarettes at both sides of said narrow enclosure will be constantly urged against one narrow side wall to be positioned for ready ejection.

U.S. Pat. No. 3,471,056

Inventor: S. R. Kovac

Issued: Oct. 7, 1969

This United States patent discloses a pill dispensing device comprising a hollow casing having a transverse opening extending therethrough and communicating with the interior thereof, an escapement finger associated with said casing for movement into and out of the casing interior within said transverse opening, said escapement finger being spring urged outwardly for movement from the interior of said casing to permit a pill to be positioned within said transverse opening and also being reinsertable within said transverse opening to selectively discharge the pill therefrom while trapping the remainder of pills within said hollow casing, said escapement finger being maintained within said transverse opening during non-use by means associated with said hollow casing.

While these dispensing devices may be suitable for the purposes for which they were designed, they would not be as suitable for the purposes of the present invention, as hereinafter described.

SUMMARY OF THE PRESENT INVENTION

The present invention discloses a device for holding and dispensing a plurality of spoons in a rapid and easy manner. Disclosed is an enclosure holding a plurality of spoons in a side by side relation whereby the spoons are withdrawn by their handle through an aperture in the top of the enclosure. A rotatable belt means is disclosed having hook-like members thereon which contact the spoon tips and thereby eject the spoons from the enclosure. The spoons are held in proper position by a slidably mounted partition having spring means for being biased against the spoons. An access door is provided in the enclosure in order to replace spoons 16 when necessary.

A primary object of the present invention is to provide means for supplying a plurality of easily retrievable sanitary spoons which can be used and disposed of after a single use.

Another object of the present invention is to provide a device having a plurality of container members and a plurality of portable dispensers attached to a holding member having mounting means for locating said dispensers in a convenient location.

Yet another object of the present invention is to provide a device having a plurality of container members providing means for storing a plurality of disposable spoons therein.

Still yet another object of the present invention is to provide a device having a plurality of portable dispenser which can be selectively detached and reattached to the holding member.

Another object of the present invention is to provide a device having a plurality of portable spoon dispensers having clip members whereby said portable spoon dispensers can be selectively attached to an apron, shirt pocket, belt or to another article of clothing.

Yet another object of the present invention is to provide a portable spoon dispenser having spring tensioning means for maintaining the spoons against the dispensing means.

Still yet another object of the present invention is to provide a portable spoon dispenser having an access port for retrieving a spoon.

Still yet another object of the present invention is to provide a portable spoon dispenser having dispensing means which hooks and advances a spoon through the access port as a first spoon is removed through said dispenser.

Another object of the present invention is to provide a spoon dispenser having a hingedly attached door providing means for replenishing the portable spoon dispenser with a plurality of spoons.

Additional objects of the present invention will appear as the description proceeds.

The present invention overcomes the shortcomings of the prior art by providing a device having a holding member having mounting means for selectively positioning said device. Said device having a plurality of open topped container members attached to said holding member providing means for storing disposable spoons therein and retrieving said spoons therefrom for inserting into a portable dispenser which is selectively removed from the holding member and having clip means for attaching said portable dispenser to an apron, pocket or belt. The portable spoon dispenser further having means for selectively dispensing one spoon at a time.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

List of Reference Numerals

Figure 1:
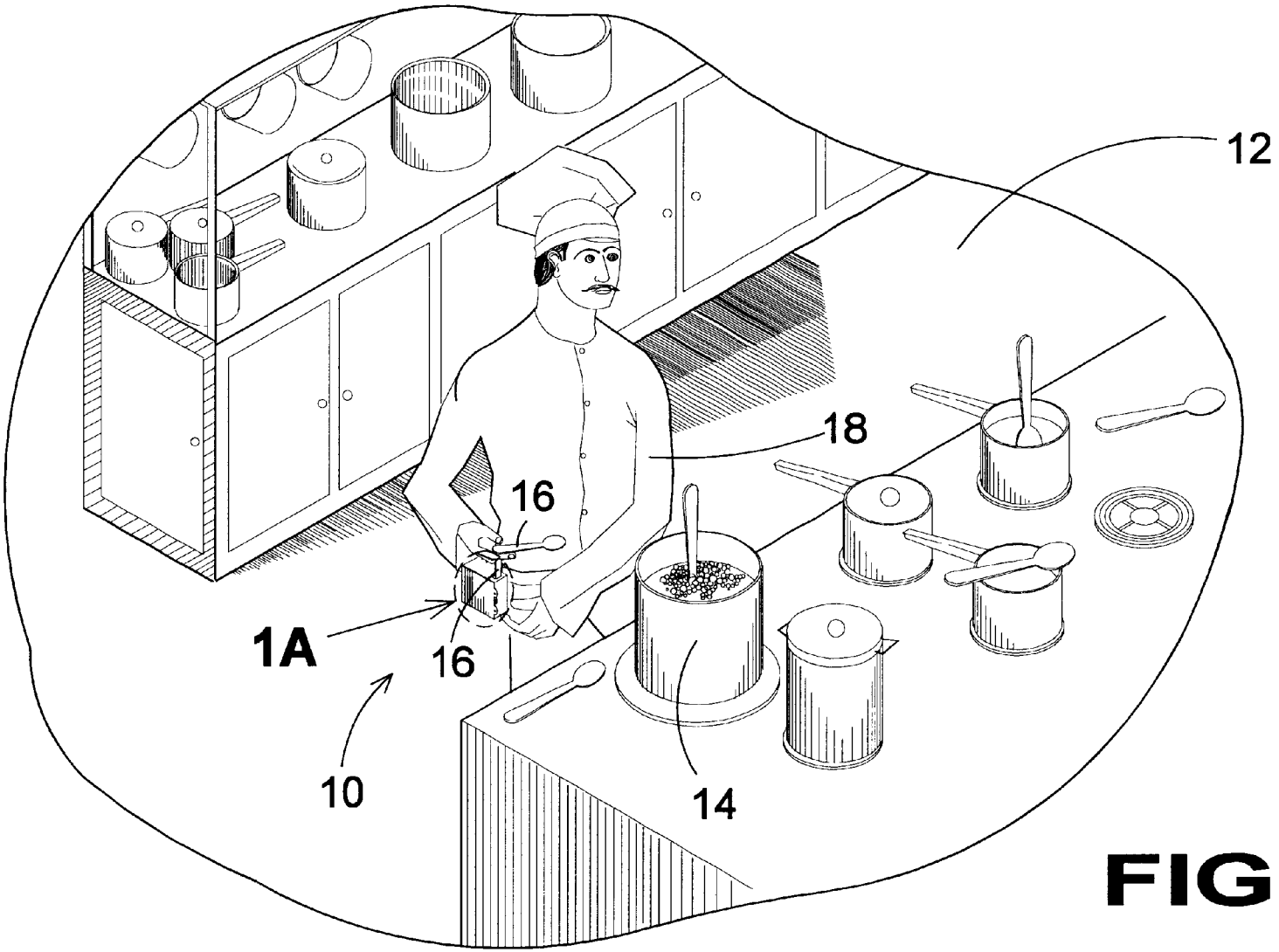
FIG. 1 is an illustrative view of a commercial kitchen having a number of different foods being prepared simultaneously and continuously. For sanitary reason a spoon should not be taken from the mouth and put into a communal food supply. From a chef's point of view, when tasting a food, such as a sauce, it is important that only the unique flavors and ingredients of the sauce be tasted and that they not be enhanced or over powered by a previously tasted food item. Therefore, it is desirable to continuously supply a plurality of clean utensils for tasting. This can be accomplished by having a number of strategically placed utensils which are continuously replaced after use or by employing the present invention which is a dispensing container having clip means for attaching said container to an article of clothing. The dispensing container having a plurality of spoons contained therein which can be selectively dispensed on a need be basis.

With regard to reference numerals used, the following numbering is used throughout the drawings.

10 present invention
12 commercial kitchen
14 food container
16 spoon
18 chef
20 aperture
22 top surface
24 access cover
26 direction arrow
28 clip means
30 enclosure
32 access door
34 movable partition
36 coil springs
37 base
38 belt
39 attachment means
40 ladle
42 spoon handle
44 tip of spoon
46 hook-like member
48 top holding member
50 spring means
52 holding member
54 mounting means
56 open top container members
58 end wall
60 side wall
61 side wall
62 end wall
63 bottom
64 latch means

66 mating latch means

68 flange

70 hinge means

72 rollers

74 shoulder-like member

76 track

DESCRIPTION OF THE PREFERRED EMBODIMENT(S)

Turning now descriptively to the drawings, in which similar reference characters denote similar elements throughout the several views, FIGS. 1 through 6 illustrate the present invention being a device for dispensing spoons.

Turning to FIG. 1, shown therein is an illustrative view of a commercial kitchen 12 having a number of different foods in containers 14 being prepared simultaneously and continuously. For sanitary reasons a spoon should not be taken from the mouth and put into a communal food supply. From a chef's 18 point of view, when tasting a food, such as a sauce, it is important that only the unique flavors and ingredients of the sauce be tasted and that they not be enhanced or over powered by a previously tasted food item. Therefore, it is desirable to continuously supply a plurality of clean utensils for tasting. This can be accomplished by having a number of strategically placed utensils which are continuously replaced after use or by employing the present invention 10 which is a dispensing container 10 having clip means 28 (not shown) for attaching said container to an article of clothing. The dispensing container 10 has a plurality of spoons 16 contained therein which can be selectively dispensed on a need be basis.

Figure 1A:
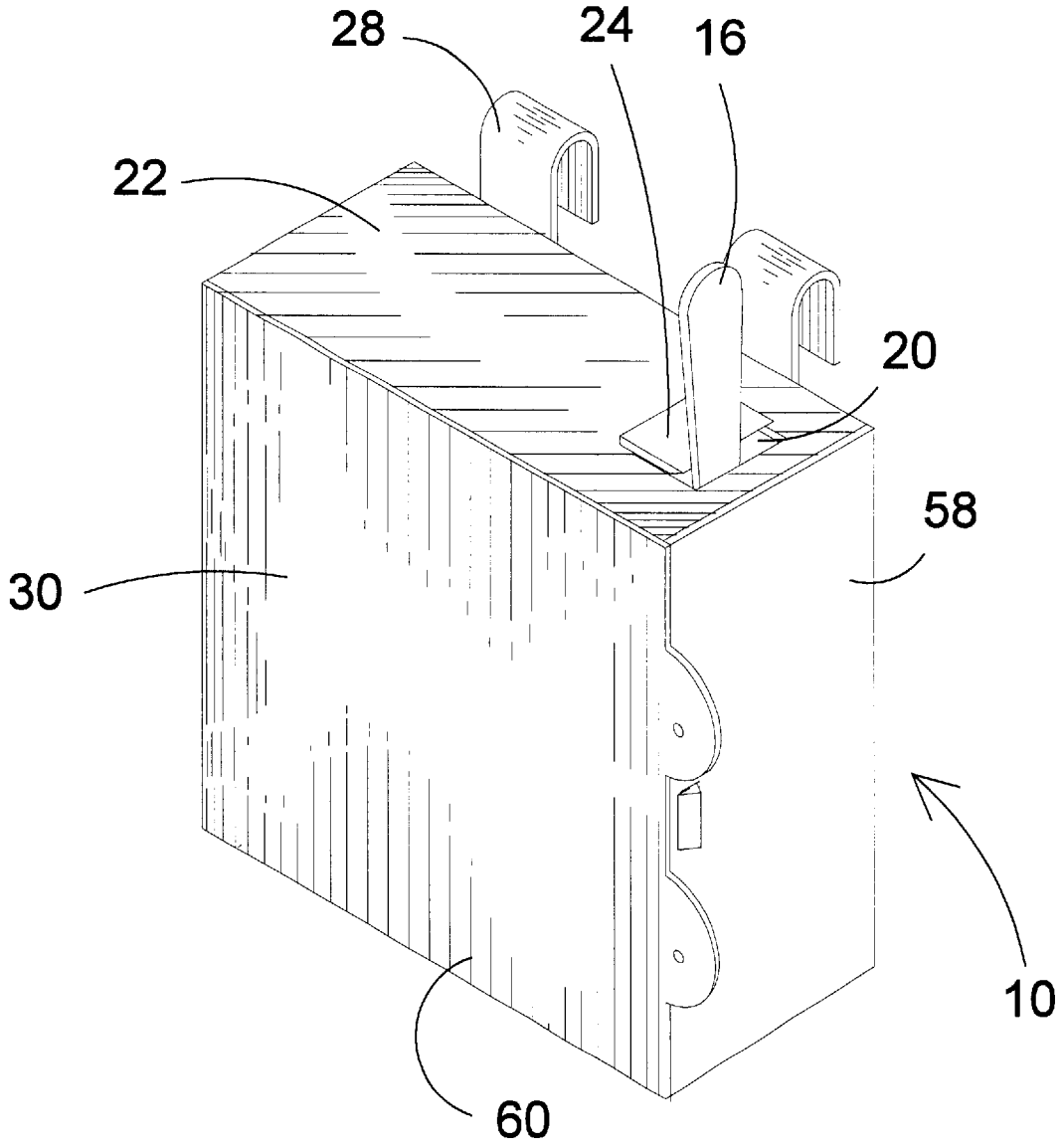
FIG. 1A is a perspective view of the present invention, taken from FIG. 1 as indicated. Shown is a portable spoon dispenser having an aperture within the top surface wherethrough a spoon can be withdrawn. The access port having spring closure means will open to remove the spoon and close upon the handle of the next spoon thereby preventing particle matter from entering the dispenser. Further said dispenser has clip means for selectively attaching the spoon dispenser to an article of clothing, such as an apron, shirt pocket, or belt. After use the portable spoon dispenser can be returned to the holding member, not shown, until needed again.

Turning to FIG. 1A, shown therein is a perspective view of the present invention 10 and its generally rectangularly shaped enclosure 30, taken from FIG. 1 as indicated. Shown is a portable spoon dispenser having an aperture or hole 20 within the top surface 22 wherethrough a spoon 16 can be withdrawn. The access cover 24 having spring closure means (not shown) will open to remove a first spoon 16 and close upon the handle of the next or succeeding spoon thereby preventing dirt or particle matter from entering the dispenser 10. The dispenser 10 has clip means 28 or selectively attaching the spoon dispenser 10 to an article of clothing, such as an apron, shirt pocket, or belt. After use the portable spoon dispenser 10 can be returned to the holding member (not shown) until needed again.

Figure 1B:
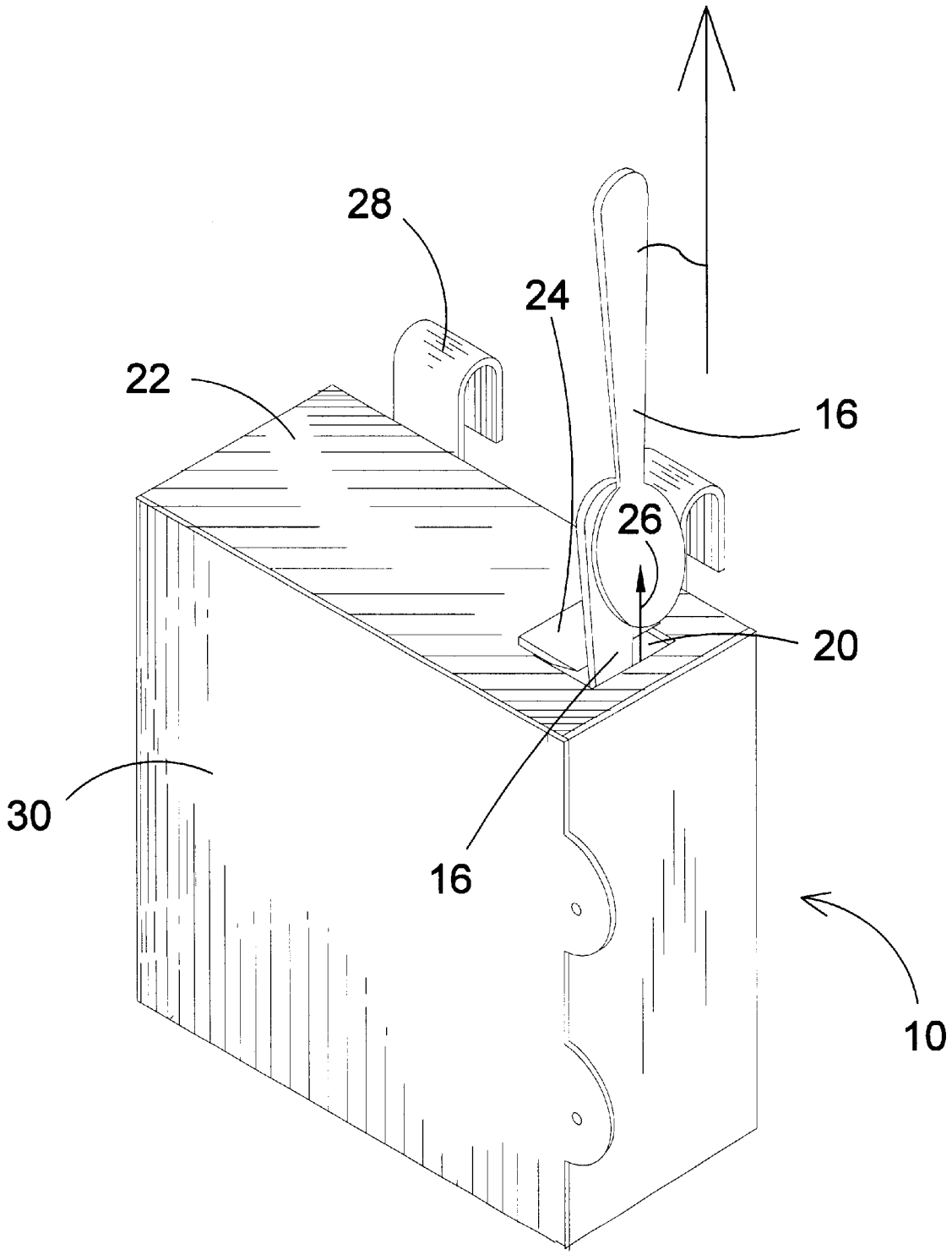
FIG. 1B is a perspective view of the present invention. Shown is a portable spoon dispenser having an aperture within the top surface wherethrough a spoon can be withdrawn. As the spoon is being withdrawn another spoon will extend partially through the access port. The access port having spring closure means will open to remove the first spoon and close upon the handle of the second spoon thereby preventing particle matter from entering the dispenser.

Turning to FIG. 1B, shown therein is a perspective view of the enclosure 30 of the present invention 10. Shown is a portable spoon dispenser 10 having an aperture 20 within the top surface 22 wherethrough a spoon 16 can be withdrawn as shown by direction arrow 26. As the first spoon 16 is being withdrawn another second or succeeding spoon 16 will extend partially through the access hole 20. The access cover 24 having spring closure means (not shown) can be opened by the hand of the user to remove the first spoon and being slidable along the longitudinal axis of top 22 will close upon the handle of the second spoon thereby preventing particulate matter from entering the dispenser. Also shown are the clip means 28.

Figure 2:
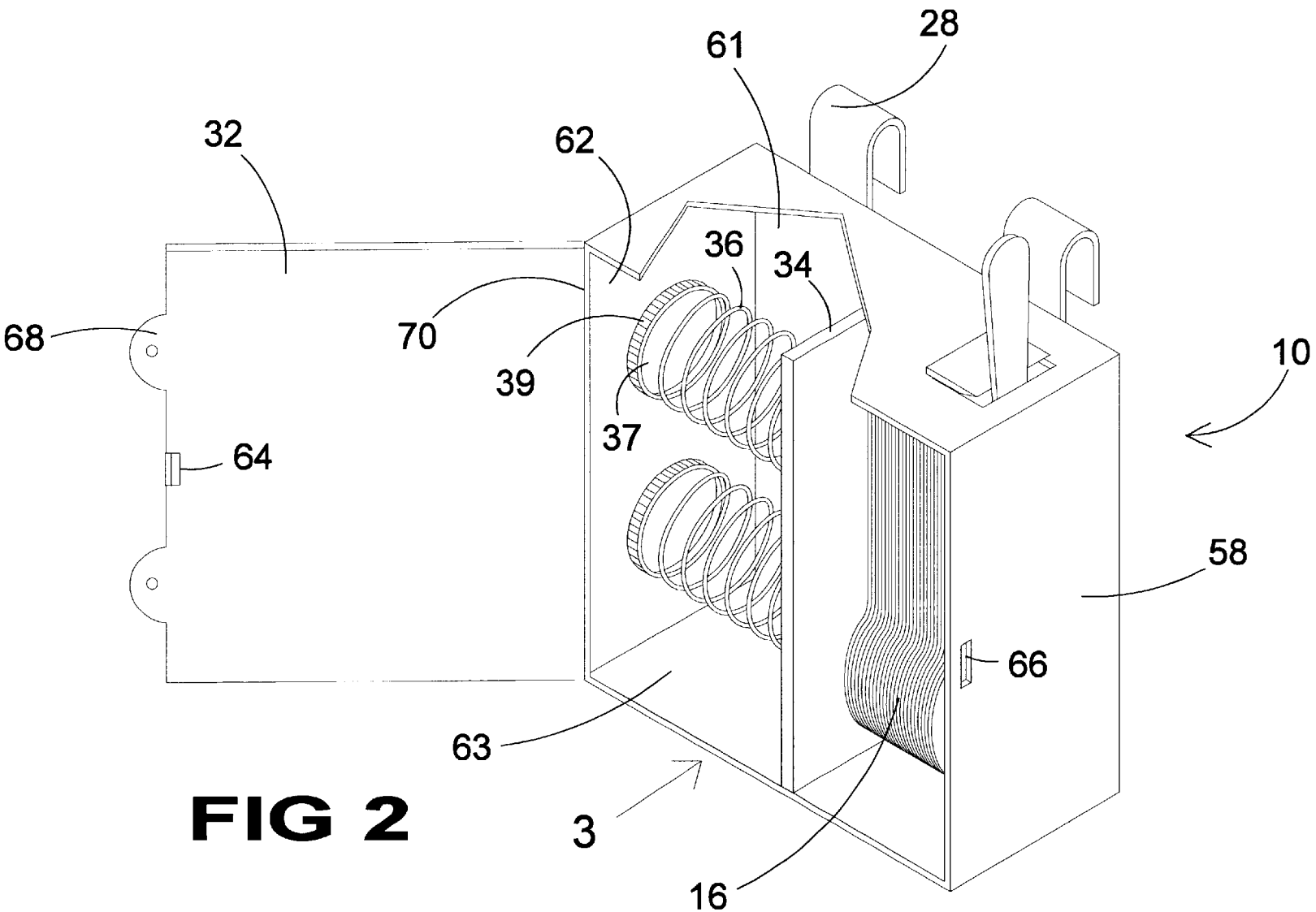
FIG. 2 is a perspective view of the present invention having the access door of the spoon dispenser in the open position and having a plurality of spoons ready for dispensing. Also shown are means for positioning the spoons at the dispensing end, said means comprising a plurality of springs having connection means with a movable partition. Said partition can be retracted to a seated position whereby a new set of spoons can be inserted.

Turning to FIG. 2, shown therein is a perspective view of the present invention 10 having the access door 32 formed by a longer side 60 of the spoon dispenser 10 the door 32 being in the open position and having a plurality of spoons 16 in side by side relation ready for dispensing. Also shown are means for positioning the spoons 16 at the dispensing end, said means comprising a plurality of springs 36 having connection means with a movable plate or partition 34. The partition 34 can be retracted to a seated position away from the spoons 16 near the base 37 of springs 36 whereby a new set of spoons can be inserted. The base 37 has a cup-like base member 39 which provides means for attachment to end wall 62. Clip means 28 are also shown along with a pair of coil springs 36 providing means for resiliently biasing partition 34 against the spoons 16. The other side wall 61 and bottom 63 are also shown. The enclosure 30 thus includes a top surface 22, a bottom surface 63, two end walls 58 and 62 with 58 being on the right and 62 being on the left, two side walls 60 and 61 with 60 being on the front and 61 being on the back or rear. The front and back walls 60 and 61 form the longer edge of the enclosure 30. Door 32 also has a latch means 64 with a mating latch means 66 for securement to end wall 58 along with two flanges 68 for grasping in order to open the door 32 and hinge means 70, e.g., a live hinge.

Figure 3:
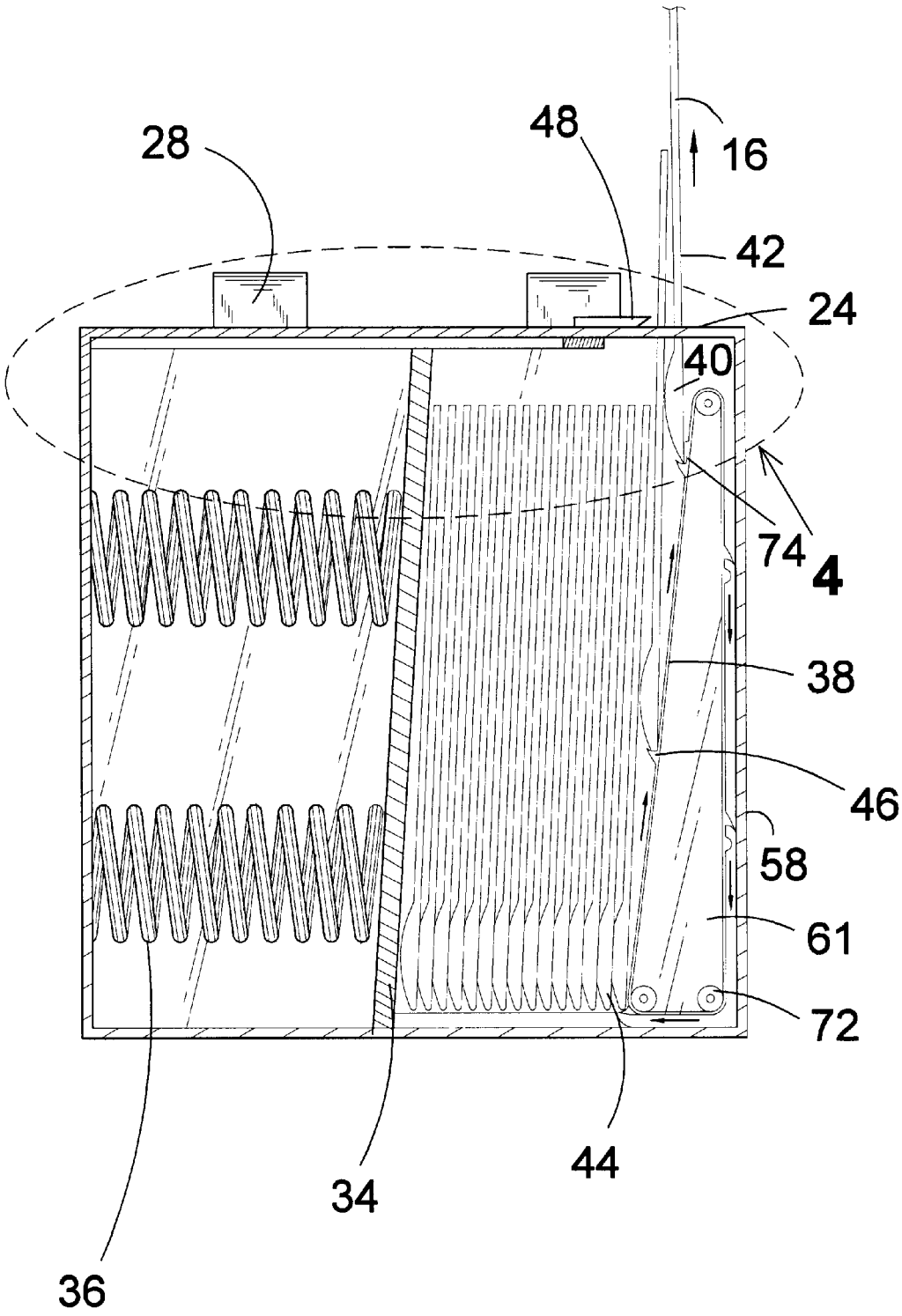
FIG. 3 is a cutaway view of the present invention. Shown is a rotatable belt having means for communicating with the ladle portion of the spoon. As the spoon with the handle extending through the access port is withdrawn. The upper portion of the ladle portion of the spoon will engage a number of nodules. The force of a user withdrawing a spoon will snag the nodules causing the belt to rotate. As the next spoon is engaged by the belt, its handle will be extended through the access port where it will remain until the procedure is repeated or there are no more spoons within the dispenser. At which a plurality of spoons can be withdrawn from the open-topped holding member and inserted into the portable spoon dispenser. The belt will then be advanced by hand will a portion of spoon handle is projecting through the access panel. At which time the device is ready for use.

Turning to FIG. 3, shown therein is a cutaway view of the present invention 10. Spoons 16 are positioned side-by-side with the ladles 40 of each spoon 16 inside the ladle of the next spoon 16 so that the spoons are thereby efficiently packed in the enclosure 30. The partition 34 is effectively the same size as end wall 58 and is slightly angled to the right of vertical in order to properly position spoons 30 for engagement with belt 38 Shown is a continuous loop rotatable belt 38 wherein the plane of the belt 38 surface travels parallel to the plane of the surface of end wall 58 belt 38 having multiple hook-like means 46 for communicating with the ladle portion 40 of the spoon 16. As the spoon with the handle 42 extending through the aperture 20 is withdrawn, the upper portion of the ladle portion of the spoon, i.e., the portion toward the tip 44 of spoon 16 will engage one of the plurality of hook-like members 46 which will eject the spoon from the enclosure 30. The outwardly pulling force of a user withdrawing a spoon 16 will snag the shoulder-like members 74 causing the belt 38 to rotate on a plurality of roller means 70 mounted perpendicular to side wall 61. As the next spoon 16 is engaged by the belt 38, its handle will be extended through the aperture 20 where it will remain until the procedure is repeated or there are no more spoons 16 within the dispenser 10 at which time a plurality of spoons 16 can be withdrawn from the open-topped holding member 56 and inserted into the portable spoon dispenser 10. When spoons 16 are initially placed in the enclosure 30 the belt 38 will then be advanced by hand until a portion of spoon handle 42 is projecting through the aperture 20 at which time the device is ready for use. Also shown are clip means 28, partition 34 and springs 36.

Figure 4:
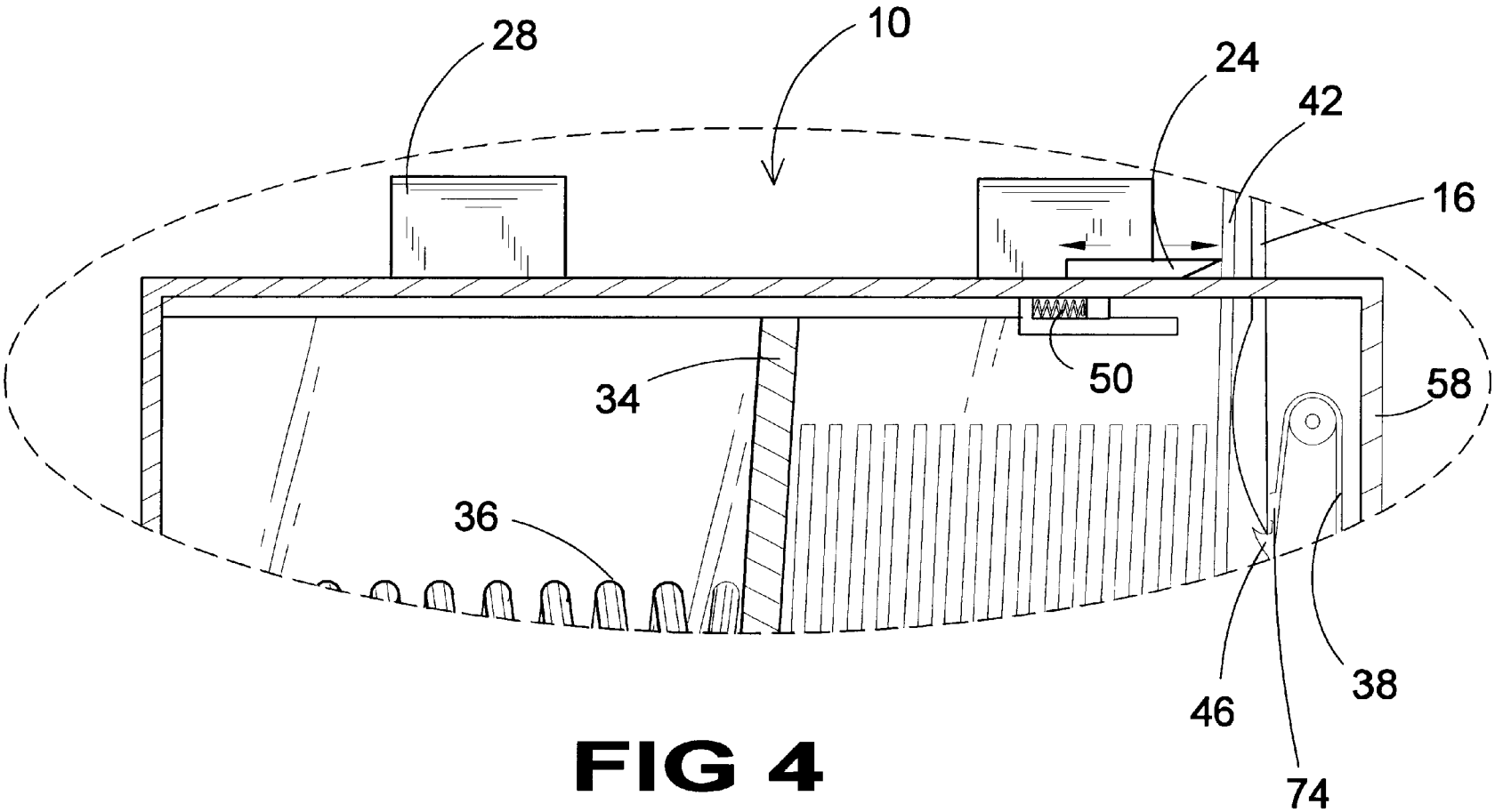
FIG. 4 is an enlarged view taken from FIG. 3 as indicated. Shown is the access port having spring means for keeping the spoon access port closed until sufficient force opens it and as the force is released the access port will return to a closed position.

Turning to FIG. 4, shown therein is an enlarged view taken from FIG. 3 as indicated. Shown is the access cover 24 having spring means 50 for keeping the slidable spoon access cover 24 closed until sufficient force opens it and as the force is released the access port will slidably return to a closed position. Shown is access cover 24 in contact with spoon handle 42 as a first spoon 16 is about to be withdrawn from the spoon dispenser 10. Spring means 50 biases cover 24 over the aperture 20 toward the nearest end wall 58 until it is forcibly slid by hand to the open position. Other features previously disclosed are also shown.

Figure 5:
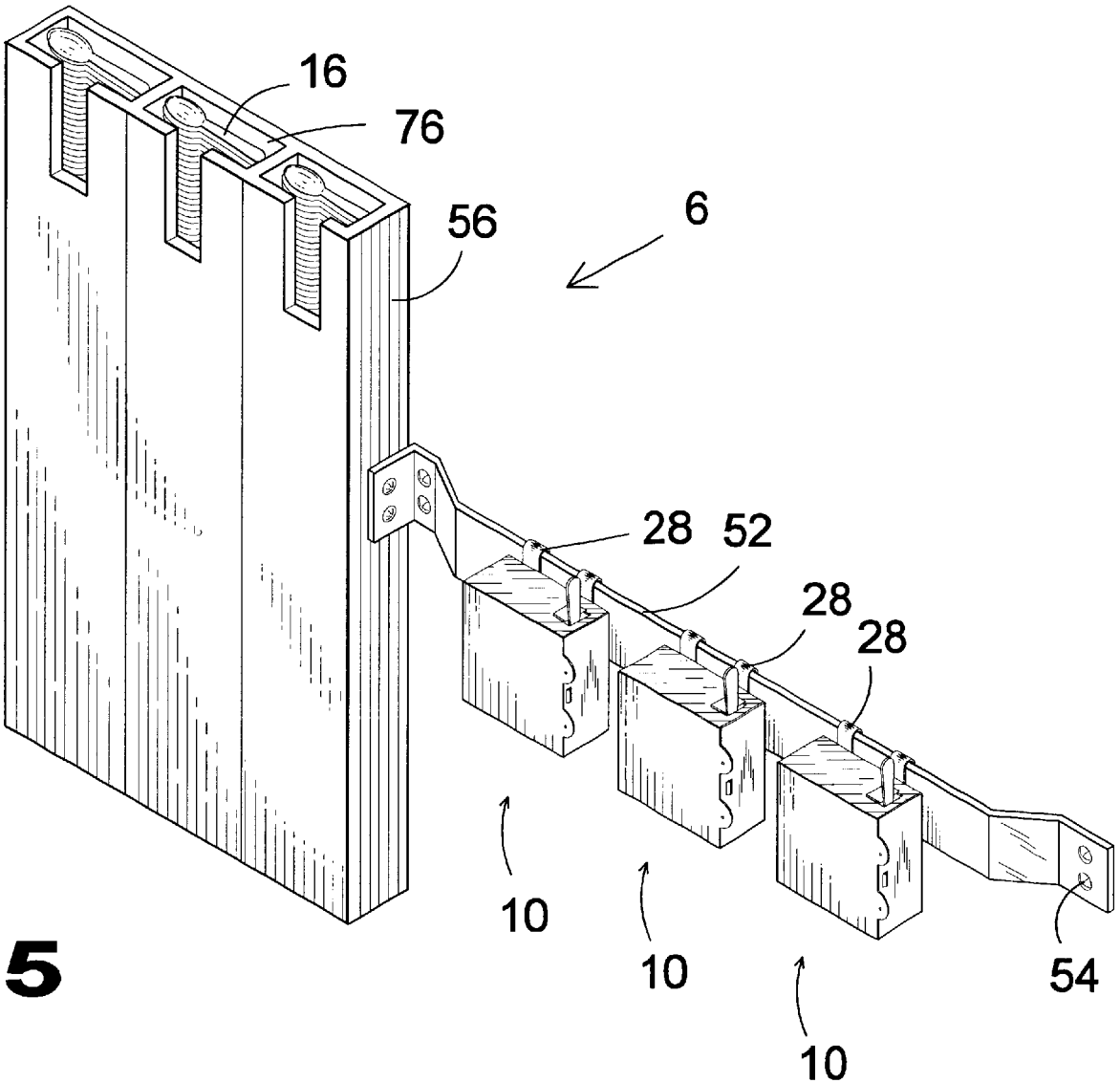
FIG. 5 is a perspective view of the present invention. Shown is a device having a holding member having mounting means for selectively positioning said device. Said device further having a plurality of open topped container members attached to the holding member providing means for storing a plurality of disposable spoons therein and having a plurality of attachable and detachable portable dispenser which can be selectively removed from the holding member and having clip means can be attached to an apron, pocket or belt.

Turning to FIG. 5, shown therein is a perspective view of the present invention 10. Shown is a device having a holding member 52 having mounting means 54, e.g., apertures with screws therethrough, for selectively positioning said device onto a proximate object. The device further has a plurality of open topped container members 56 having tracks therein 76 having spoons 16 therein, the device attached to the holding member 52 providing means for storing a plurality of disposable spoons 16 therein and having a plurality of attachable and detachable portable dispenser 10 which can be selectively removed from the holding member 52 and having clip means 28 can be attached to an apron, pocket or belt.

Figure 6:
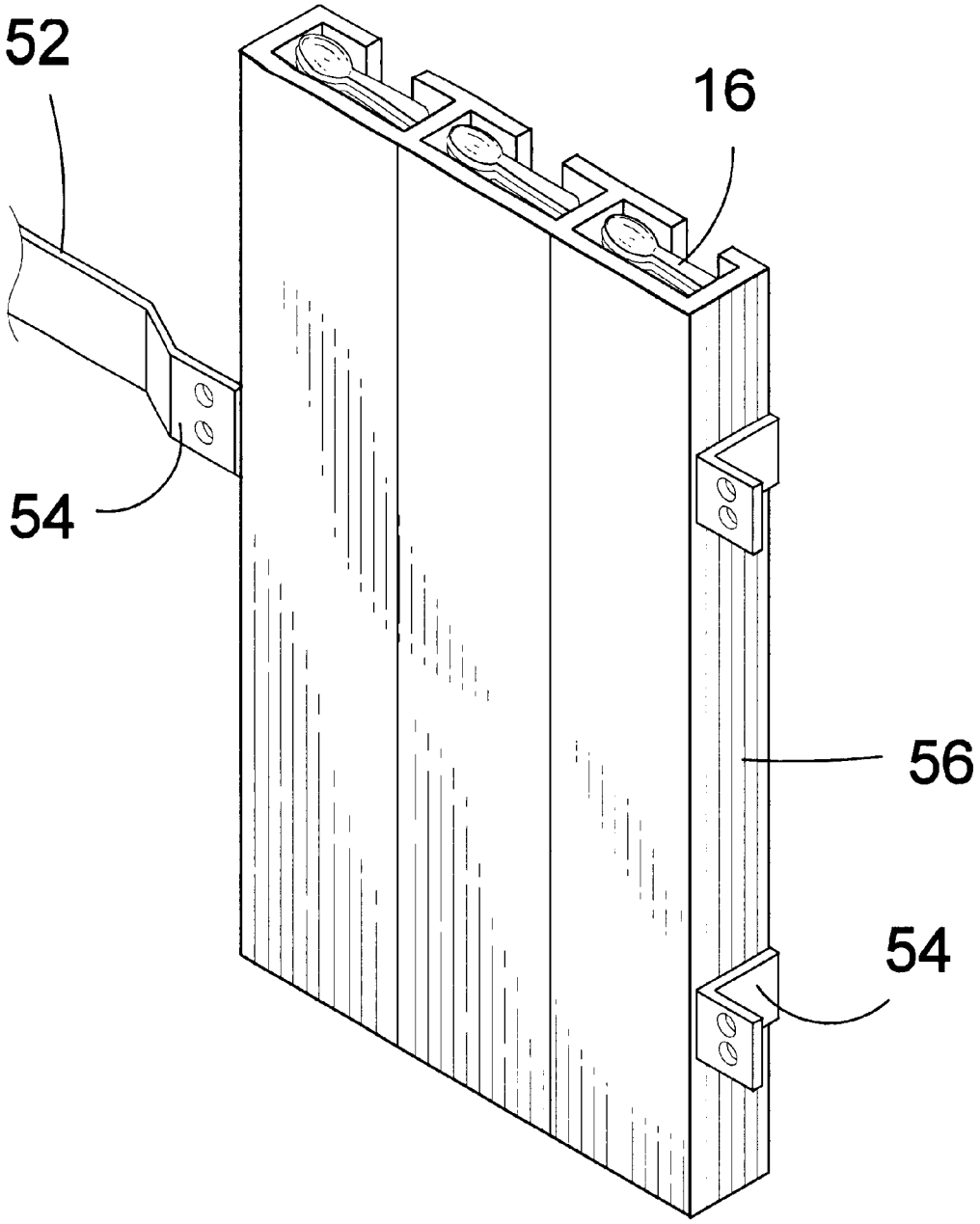
FIG. 6 is a back perspective view of the container holding member. Said canister holding member has spring means for advancing the stack of spoons as some are being removed therefore and placed into the portable spoon dispensers.

Turning to FIG. 6, shown therein is a back perspective view of the container holding member 56. Said canister holding member has spring means (not shown) for advancing upwardly the stack of spoons 16 as some arc being removed therefore and placed into the portable spoon dispensers. Also shown are holding member 52 with mounting means 54.

What is claimed to be new and desired to be protected by Letters Patent is set forth in the claims:

1. An apparatus for dispensing spoons, comprising:

a) a generally rectangular shaped enclosure;

b) said enclosure defined by a top, a bottom, a pair of sides being a front side and a rear side, and a pair of ends being a right end and a left end;

c) an access door;

d) said access door for the spoons formed by one of the sides of said rectangular enclosure;

e) said top having an aperture therein through which a spoon can pass;

f) a belt means for ejecting a spoon from said enclosure;

g) a partition for urging the spoons into communication with said belt means; and, h) a first spring means for biasing said partition against said spoons.

2. The apparatus of claim 1, wherein said pair of sides are the longer sides of said generally rectangular shaped enclosure.

3. The apparatus of claim 2, wherein said access door is formed by one of the longer sides of said enclosure.

4. The apparatus of claim 3, further comprising a latch means on said door.

5. The apparatus of claim 4, further comprising said door having a mating latch means on one of said end walls, said door being secured by said latch means.

6. The apparatus of claim 1, further comprising a cover on said aperture on said top.

7. The apparatus of claim 6, wherein said cover is slidable, said cover being mounted in said top.

8. The apparatus of claim 7, further comprising a second spring means for slidably moving said cover along the longitudinal axis of said top, said spoons being removable from said enclosure through said aperture in said top.

9. The apparatus of claim 8, further comprising said spoons positioned in said container in a side by side relation, said spoons positioned with the ladles of said spoons positioned inside each succeeding spoon ladle, said spoons being efficiently positioned inside said enclosure.

10. The apparatus of claim 9, further comprising said partition being slidably movable, said partition being effectively the same size as said end wall.

11. The apparatus of claim 10, further comprising said first spring means mounted on a first of said end walls, said partition positioned between said first spring means and said spoons and a second of said end walls, said belt means positioned between said spoons and said second end wall, said partition urging said spoons toward said belt means.

12. The apparatus of claim 11, further comprising said belt means being rotatably mounted, said belt being a continuous loop for ejecting spoons from said enclosure, wherein the plane of said belt surface travels parallel to the plane of the surface of said end wall.

13. The apparatus of claim 12, further comprising said belt rotatably mounted on rollers, said rollers mounted on said side wall, said rollers mounted perpendicular to said side wall, said belt having means for engaging said spoons for ejecting spoons from said enclosure.

14. The apparatus of claim 13, said means for engaging said spoons further comprising a plurality of hook-like members, said hook-like members positioned on the external surface of said belt, said hook-like member engaging the tips of said spoons, said spoons being ejected from said enclosure by said belt as said belt is rotated.

15. The apparatus of claim 14, said hook-like members further comprising a shoulder member for removable engagement to said spoons, said belt being rotatable in response to said spoon being engaged to said shoulder member, said belt rotably responsive to said spoon being pulled from and removed from said enclosure by the hand of the user, said succeeding spoon being partially removed from said enclosure as said belt is rotated.

16. The apparatus of claim 1, further comprising a member for holding thereon a plurality of said apparatuses, said member for holding having means for mounting onto a proximate object for accessing said apparatuses.

17. The apparatus of claim 16, further comprising an upright standing container for holding a plurality of said spoons, said container having a track therein said track holding a plurality of spoons therein, having spring means for upwardlly advancing said spoons in said track.

* * * * *